US005706539A

United States Patent [19]

Fukuda

[11] Patent Number: 5,706,539

[45] Date of Patent: Jan. 13, 1998

[54] WATER TANK CLEANING MACHINE

[76] Inventor: Kakutaro Fukuda, 2-11 Ohamacho, Amagasaki, Hyogo-Pref, Japan

[21] Appl. No.: 650,017

[22] Filed: May 17, 1996

[30] Foreign Application Priority Data

Aug. 7, 1995 [JP] Japan ..... 7-222616

[51] Int. Cl.[6] ..... E04H 4/16

[52] U.S. Cl. ..... 15/1.7

[58] Field of Search ..... 15/1.7

[56] References Cited

U.S. PATENT DOCUMENTS

| | | | |
|---|---|---|---|
| 3,321,787 | 5/1967 | Myers | 15/1.7 |
| 3,886,616 | 6/1975 | Hayes | 15/1.7 |
| 4,011,827 | 3/1977 | Fond | 15/1.7 X |
| 4,052,950 | 10/1977 | Hirata | 15/1.7 X |
| 4,574,722 | 3/1986 | Orita et al. | 15/1.7 X |
| 5,044,034 | 9/1991 | Iannucci | 15/1.7 |
| 5,093,950 | 3/1992 | Heier | 15/1.7 |
| 5,245,723 | 9/1993 | Sommer | 15/1.7 |
| 5,337,434 | 8/1994 | Erlich | 15/1.7 |
| 5,351,355 | 10/1994 | Chiniara | 15/1.7 |

FOREIGN PATENT DOCUMENTS

| | | | |
|---|---|---|---|
| 314259 | 5/1989 | European Pat. Off. | 15/1.7 |
| 2462206 | 3/1981 | France | 15/1.7 |
| 2685374 | 6/1993 | France | 15/1.7 |
| 1092133 | 11/1967 | United Kingdom | 15/1.7 |

*Primary Examiner*—Mark Spisich
*Attorney, Agent, or Firm*—Moonray Kojima

[57] ABSTRACT

The invention relates to a water tank cleaning machine used in cleaning operation of water tank such as aquarium, swimming pool and bathtub, characterized by rotating a suction impeller pivoted on a second suction chamber by rotating device, sucking storage water in the water tank through each suction port formed in first suction chamber and second suction chamber, transmitting the torque of the rotating device to wiping device through power transmission device, and stopping the wiping device only due to resistance caused at the time of contact if a hand of the worker or aquatic creature or other object contacts with the wiping device, thereby preventing injury of the object, so that it is easy to handle and safe, and moreover, since the water tank is cleaned while filtering the storage water, contamination of storage water during cleaning work is prevented, and the water quality and environments suited to rearing of aquatic life such as fishes and mammals can be maintained, and further, since the water tank can be cleaned while holding the storage water therein, the labor of discharging or replacing storage water is omitted, and the inner wall and deposits of the water tank can be cleaned easily, thereby enhancing the working efficiency and cleaning efficiency.

3 Claims, 11 Drawing Sheets

WATER TANK CLEANING MACHINE

BACKGROUND OF THE INVENTION

1. Field of the Invention

The present invention relates to a water tank cleaning machine for cleaning a water tank made of concrete, glass, synthetic resin or the like used in, for example, aquarium, general household, display, swimming pool, and bathtub.

2. Description of the Prior Art

Hitherto, as a method of cleaning the inside of such water tank as mentioned above, for example, storage water such as water or seawater stored in the water tank was once discharged, and scales and moss depositing on the wall and bottom of water tank were washed off by manual work using a brush.

The water tank for aquarium is, however, large in volume for rearing large fishes and mammals, and contains a large volume of seawater, and therefore when cleaning the inside of the water tank after once discharging the seawater, it not only takes a very long time to discharge and charge seawater in the water tank, but also the aquatic creatures such as fishes and mammals must be transferred into other water tank, and it takes labor and time in cleaning work.

If cleaned without discharging the seawater stored in the water tank, the clarity of seawater is lowered by scales and moss removed at the time of cleaning, and it is hard to check the cleaning state, and the seawater is contaminated by the removed scales and moss, and the stored seawater in the water tank must be replaced with fresh seawater after cleaning.

SUMMARY OF THE INVENTION

It is hence a primary object of the invention to present a water tank cleaning machine characterized by rotating a suction impeller pivoted on a second suction chamber by rotating means, sucking storage water in the water tank through each suction port formed in first suction chamber and second suction chamber, transmitting the torque of the rotating means to wiping means through power transmission means, and stopping the wiping means only due to resistance caused at the time of contact if a hand of the worker or aquatic creature or other object contacts with the wiping means, thereby preventing injury of the object, so that it is easy to handle and safe. Moreover, since the water tank is cleaned while filtering the storage water, contamination of storage water during cleaning work is prevented, and the water quality and environments suited to rearing of aquatic life such as fishes and mammals can be maintained. Further, since the water tank can be cleaned while holding the storage water therein, the labor of discharging or replacing storage water is omitted, and the inner wall and deposits of the water tank can be cleaned easily, thereby enhancing the working efficiency and cleaning efficiency.

It is other object of the invention to present a water tank cleaning machine characterized by rotating a suction impeller pivoted on a second suction chamber and a rear impeller pivoted on an impeller compartment by rotating means, transmitting the torque of the rear impeller to a front impeller by the flowing action of liquid (for example, storage water, seawater, oil) sealed in the impeller compartment to rotate wiping means coupled with the front impeller, and amplifying the torque of the rotating means by rotating action of each impeller to be transmitted to the wiping means, thereby obtaining a large torque and cleaning efficiently the inner wall and deposits of the water tank.

It is a further object of the invention to present a water tank cleaning machine characterized by rotating a suction impeller pivoted on a second suction chamber by rotating means, sucking storage water in the water tank through each suction port formed in first suction chamber and second suction chamber, simultaneously discharging storage water from a drain port formed in the second suction chamber, feeding storage water into a discharge port formed in an impeller compartment through a return passage, and blowing storage water discharged from discharge port into the impeller to give a torque to rotate wiping means coupled with the impeller, thereby efficiently cleaning the inner wall and deposits of the water tank, and effectively utilizing the storage water sucked in the equipment main body.

Further objects of the invention will be better appreciated from the following detailed description taken in conjunction with the drawings.

DESCRIPTION OF THE PREFERRED EMBODIMENTS

Figure 1:
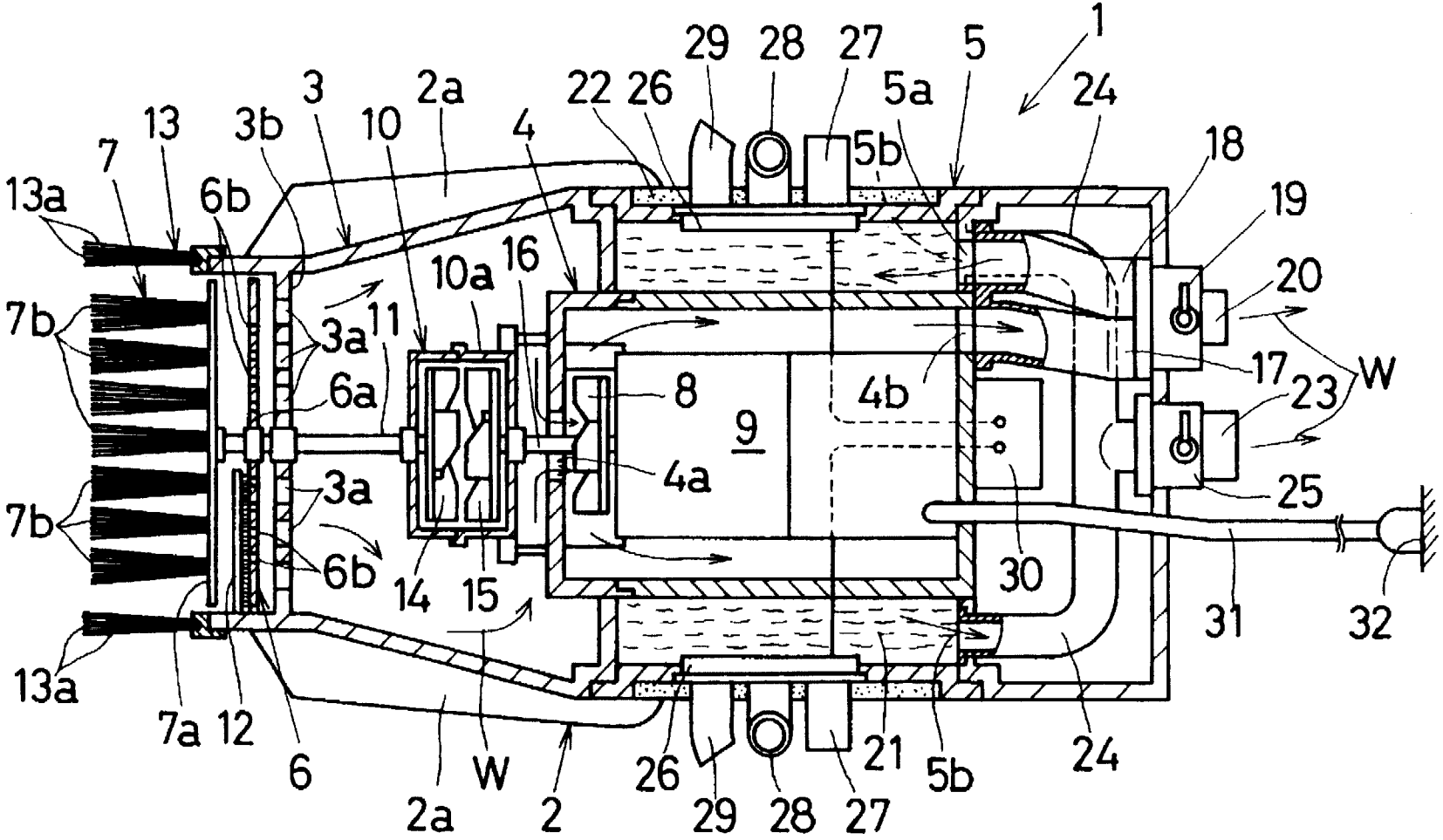
FIG. 1 is a lateral sectional plan view of a water tank cleaning machine of the invention.

Referring now to the drawings, an embodiment of the invention is described in detail below.

The drawings show a water tank cleaning machine used in cleaning work of inner wall and deposits of water tank, and in FIG. 1, this water tank cleaning machine 1 divides the internal space of an equipment main body 2 having a hollow shape into a first suction chamber 3, a second suction chamber 4, and a cleaning filter chamber 5 (hereinafter called filter chamber), a shield plate 6 and a rotary brush 7, as wiping means are pivoted at the suction side front position of the first suction chamber 3, a suction impeller 8 is pivoted at the suction side rear position of the second suction chamber 4, the suction impeller 8 is rotated by driving force of a motor 9 as rotating means fixed in the second suction chamber 4, and storage water W in a water tank A (see FIG.

2) is sucked in through suction ports 3a, 4a formed in the suction chambers 3, 4. At the same time, the torque of the motor 9 is amplified by a torque converter 10, and transmitted to the rotary brush 7, and thereby the wall Aa (see FIG. 6) and bottom Ab (see FIG. 7) of the water tank A, and sand and pebbles spread in the water tank bottom Ab and sediments B are cleaned by rotation of the rotary brush 7, and the storage water W sucked in the filter chamber 5 is filtered and discharged outside the machine.

The first suction chamber 3 rotatably pivots a rotary shaft 11 in the central part of a partition wall 3b formed in the front part of the chamber 3, multiple suction ports 3a . . . are formed at specific intervals at the front side of the partition wall 3b centered about the rotary shaft 11, the shield plate 6 and rotary brush 7 are disposed close to each other at specific interval to the axial direction at the front position side of the partition wall 3b confronting the suction ports 3a . . . , and a projection side end portion of the rotary shaft 11 is directly coupled to the center of rotation of the shield plate 6 and rotary brush 7. In the center of the first suction chamber 3, an enclosed type torque converter 10 is fixed at a position remote by a specific interval to the front wall of the second suction chamber 4, the rotary shaft 11 of the rotary brush 7 is directly coupled to the output side of the torque converter 10, and a rotary shaft 16 of the motor 9 is directly coupled to the input side of the torque converter 10.

Figure 2:
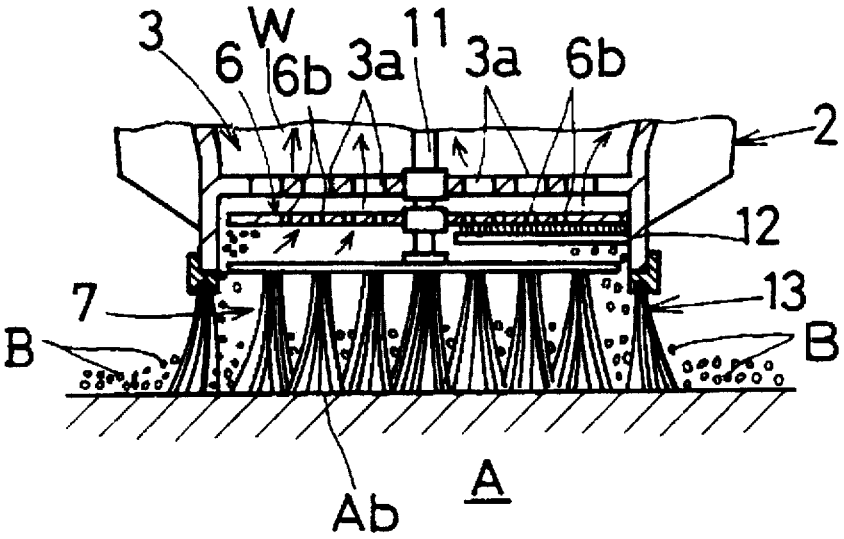
FIG. 2 is a longitudinal sectional side view showing cleaning operation of water tank bottom by wiping means.
Figure 3:
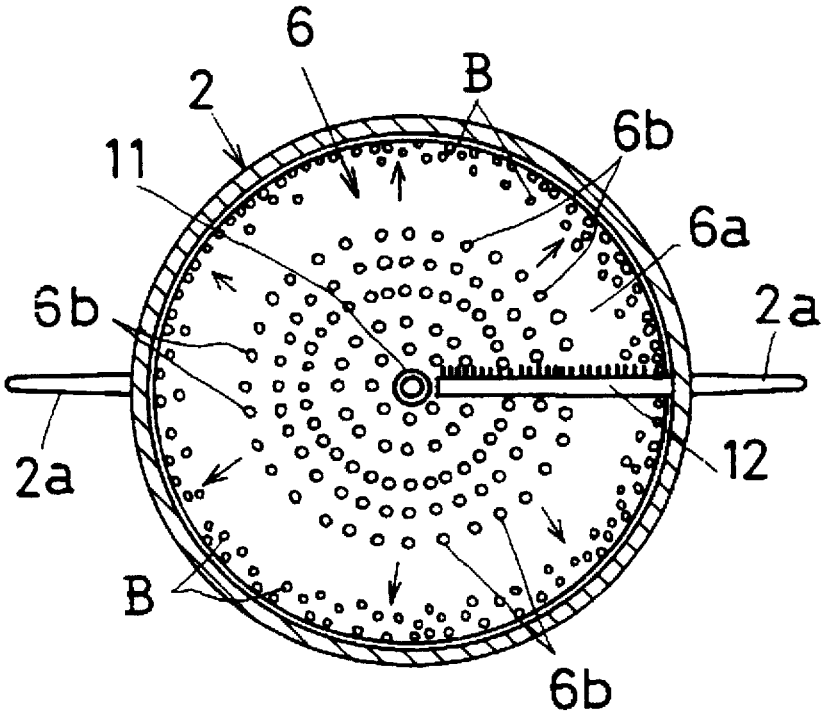
FIG. 3 is a longitudinal sectional front view showing accumulating operation of deposits by a shielding plate.

The shield plate 6 has a disk-shaped plate body 7a disposed oppositely to the front side of the partition wall 3b formed in the first suction chamber 3 as shown in FIG. 2 and FIG. 3, the projection side end portion of the rotary shaft 11 is inserted and fixed in the center of rotation of the plate body 6a, and multiple holes 6b . . . are formed at specific intervals at the front side of the plate body 6a around the rotary shaft 11, and the holes 6b . . . are formed in a slightly smaller diameter than the particle sizes of sand, pebbles and sediments B. At the front side peripheral edge of the shield plate 6, a removal brush 12 formed in a length corresponding to the radius of the plate 6 is provided oppositely, and sand, pebbles and other sediments B accumulated in the front side peripheral edge of the shield plate 6 are removed by the removal brush 12.

The rotary brush 7 has a disk-shaped rotary plate 7a disposed oppositely to the front side of the shield plate 6, the projection side end portion of the rotary shaft 11 is inserted and fixed in the center of rotation of the rotary plate 7a, and multiple bristles 7b . . . made of elastic material such as synthetic rubber are planted at equal specific intervals at the front side of the rotary plate 7a. At the front side peripheral edge of the first suction chamber 3, a brush cover 13 formed in a size for enclosing the entire circumference of the rotary brush 7 is fitted and fixed, and multiple bristles 13a . . . made of elastic material such as synthetic rubber are planted in the peripheral edge of the brush cover 13, at equal specific intervals in the circumferential direction.

The torque converter 10 has a proper amount of sealing liquid such as tap water, seawater, and oil, charged in a liquid-tight enclosed impeller compartment 10a, a front impeller 14 and a rear impeller 15 are pivoted inside of the compartment 10a closely at a specific interval in the axial direction, and the rotary shaft 11 of the rotary brush 7 is directly coupled in the center of rotation of the front impeller 14 pivoted at the outside of the inside of the compartment 10a, and the rotary shaft 16 of the motor 9 is directly coupled in the center of rotation of the rear impeller 15 pivoted at the input side of the rear part of the compartment 10a, and the torque of the motor 9 is amplified by the torque converter 10, and is transmitted to the rotary brush 7. Incidentally, same action and torque are obtained by opening part of the impeller compartment 10a and passing the storage water W sucked in the first suction chamber 3 into the impeller compartment 10a.

The second suction chamber 4 has the suction impeller 8 pivoted closely at a specific interval in the axial direction, to the rear position side of the suction port 4a formed in the front wall of the chamber 4, and the rotary shaft 16 of the motor 8 fixed in the center of the chamber 4 is directly coupled with the center of rotation of the suction impeller 8. A discharge passage 17 is connected to a discharge port 5a formed in the rear wall of the second suction chamber 4, and a return passage 18 is connected to the suction port 5a formed in the rear wall of the filter chamber 5, and the passages 17 and 18 are connected to a first discharge port 20 formed in the rear wall of the equipment main body 2 through changeover valve 19 of manual or electromagnetic type.

The filter chamber 5 has a filter 21 made of, for example, resin fiber, metal fiber, porous material, and other porous structure, placed replaceably in the internal space of the chamber 5, and when the filtering function of the filter 21 is lowered, the rear side of the equipment main body 2 is separated and released, and the filter 21 is taken out, and the contaminated filter 21 is cleaned or replaced with a new filter 21. In the upper peripheral surface (for example, about ⅔) of the chamber 5, a float member 22 made of, for example, foamed styrol is fitted, and the equipment main body 2 is lifted by buoyancy of the float member 22, so that the position of the equipment main body 2 is maintained with the float member 22 side upward. Incidentally, the buoyancy can be also adjusted by filling the internal space of horizontal blades 2a, 2a formed at both peripheral sides of the equipment main body 2 with the float member 22, or varying the size or area of the float member 22 mounted on the upper periphery of the filter chamber 5. Two discharge ports 5b, 5b formed in the rear wall of the filter chamber 5 are connected to discharge passages 24, 24, and the passages 24, 24 are united and connected at the second discharge port 23 formed in the rear wall of the equipment main body 2 through the changeover valve 25 of manual type or electromagnetic type.

Figure 4:
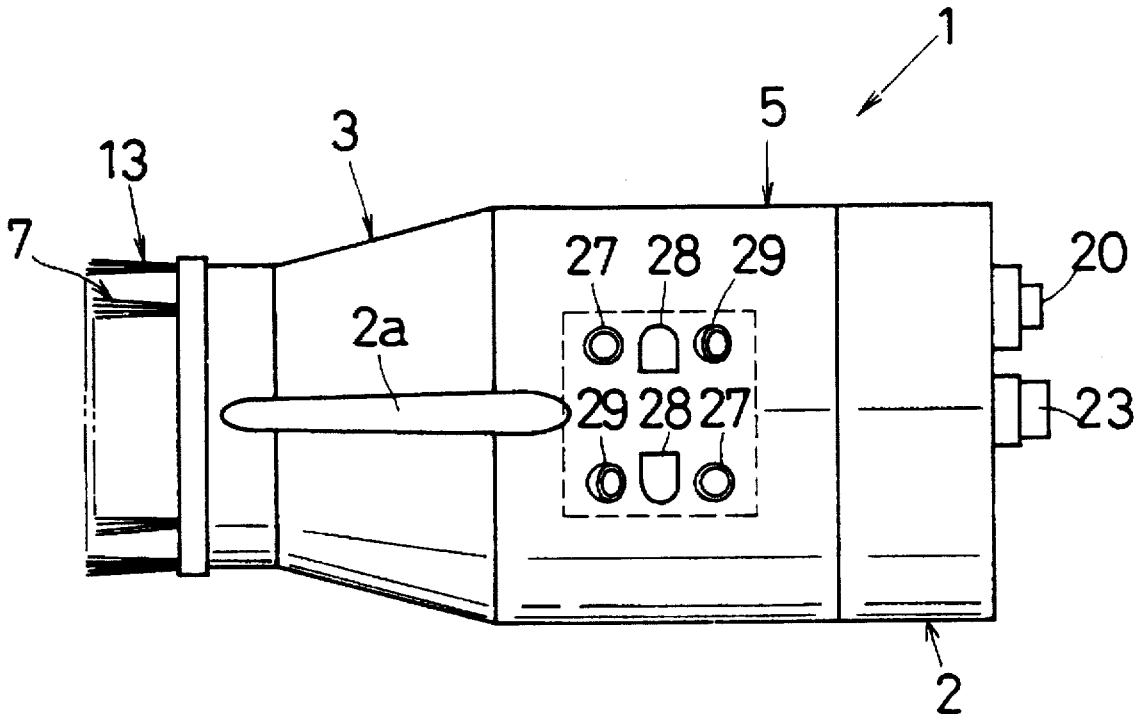
FIG. 4 is a side view showing the injection direction of each injection port disposed parallel on both side peripheral surfaces of the equipment main body.

Moreover, as shown in FIG. 1 and FIG. 4, communicating with the filter chamber 5, injection ports 27, 27 for lateral move, injection ports 28, 28 for elevating, and injection ports 29, 29 for tilting are disposed parallel at specific intervals in the axial direction, through electromagnetic changeover valves 26, 26 on the outer circumference of both sides of the equipment main body 2, and the injection ports 27, 27 for lateral move are specified in lateral direction to the equipment main body 2, the injection ports 28, 28 for elevating are specified in the vertical direction to the equipment main body 2, and the injection ports 29, 29 for tilting are specified in oblique rear direction to the equipment main body 2.

The motor 9 and electromagnetic changeover valves 26,26 are electrically connected to a receiver 30 fixed in the rear inner wall of the equipment main body 2, and a power cord 31 connected to the motor 9 is connected to a power supply unit 32 outside of the tank. That is, as shown in FIG. 5, a signal transmitted from a wireless controller 33, and driving and stopping of the motor 9 and opening and closing of the electromagnetic changeover valves 26, 26 are controlled by a command signal issued from the receiver 30.

The illustrated embodiment (first embodiment) is thus constituted, and the operation of cleaning the inner wall and sediments B of the water tank A by the water tank cleaning machine 1 is described below.

First, the equipment main body 2 is immersed in storage water W such as water or seawater contained in the water tank A, and the equipment main body 2 is maintained in a position floating on the water surface by buoyancy of the float member 22. The worker manipulates the controller 33, and rotates the suction impeller 8 pivoted on the second suction chamber 4 by driving force of the motor 9, and contaminated storage water W in the water tank 1 is sucked in through suction ports 3a, 4a of the first suction chamber 3 and second suction chamber 4. Opening the changeover valve 25 provided in the second discharge port 23 of the equipment main body 2, the changeover valve 19 provided in the first discharge port 20 is changed over to supply the storage water W discharged from the discharge port 4b of the second suction chamber 4 into the second discharge port 23 of the equipment main body 2 and the suction port 5a of the filter chamber 5. At the same time, the storage water W supplied in the filter chamber 5 is filtered by the filter 21, and the storage water W is discharged from the second discharge port 23 of the equipment main body 2, thereby providing the equipment main body 2 with propulsive force.

Figure 5:
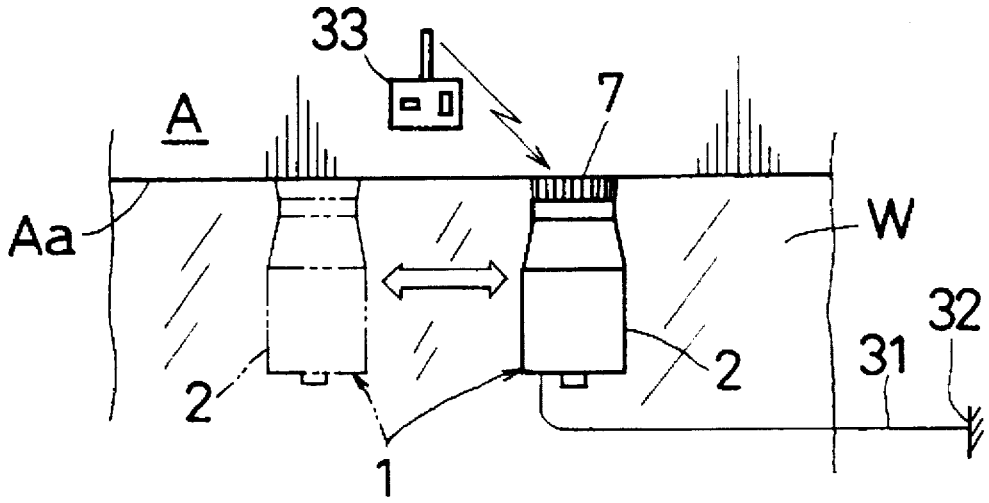
FIG. 5 is a plan view showing lateral move of the equipment main body.

Next, when cleaning the upper wall Aa of the water tank A, as shown in FIG. 5, storage water W is sucked in from suction ports 3a . . . of the first suction chamber 3, and the storage water W is discharged from the second discharge port 23 of the equipment main body 2, and the rotary brush 7 pivoted on the equipment main body 2 is pressed to the wall Aa of the water tank A. At the same time, only the injection ports 27,27 disposed at one peripheral side of the equipment main body 2 are opened, and the equipment main body 2 is moved horizontally in the lateral direction while pressing against the wall Aa of the water tank A by the discharge pressure of the storage water W discharged from the injection ports 27, 27, and the dirt depositing on the wall Aa is cleaned and removed by the rotary brush 7.

Figure 6:
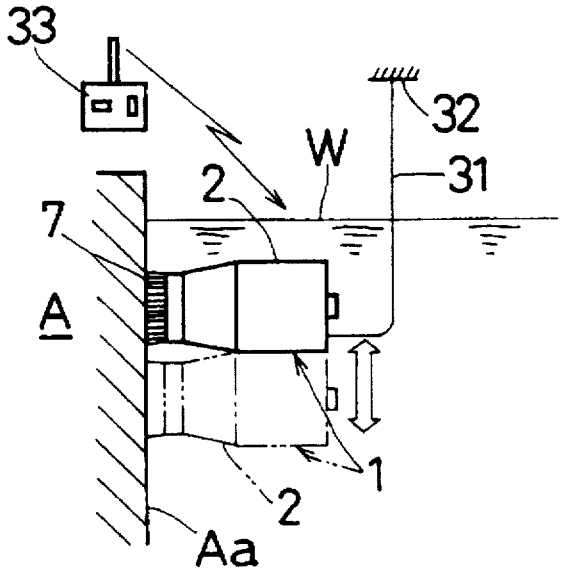
FIG. 6 is a side view showing elevating move of the equipment main body.

When cleaning the lower wall Aa of the water tank A, as shown in FIG. 6, only the injection ports 28,28 of the upward side disposed on both peripheral sides of the equipment main body 2 are opened, and the equipment main body 2 is slightly lowered in the vertical direction while pressing against the wall Aa of the water tank A by the discharge force of the storage water W discharged from the injection ports 28, 28, and, same as mentioned above, the equipment main body 2 is moved horizontally in the lateral direction while pressing against the wall Aa of the water tank A, thereby cleaning and removing the dirt depositing on the wall Aa of the water tank A by the rotary brush 7.

Figure 7:
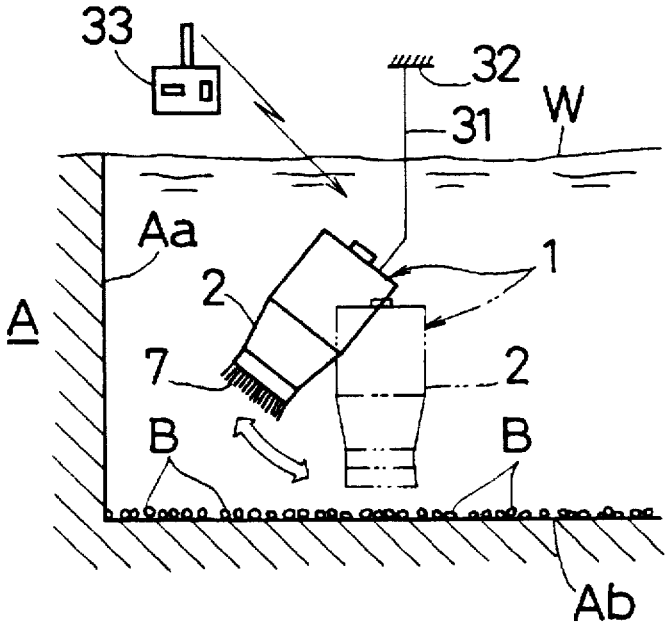
FIG. 7 is a side view showing tilting move of the equipment main body.

When cleaning the moss or scales depositing in the bottom Ab of the water tank A, or cleaning the sediments B such as sand and pebbles spread in the bottom Ab of the water tank, as shown in FIG. 7, only the injection ports 29, 29 disposed at both sides behind the equipment main body 2 are opened, and the equipment main body 2 is turned in direction in the downward position to confront the bottom Ab of the water tank A by the discharge force of the storage water W discharged from the injection ports 29, 29, and the storage water W is sucked in from suction ports 3a . . . of the first suction chamber 3, and the storage water W is discharged from the second discharge port 23 of the equipment main body 2, and the rotary brush 7 pivoted on the equipment main body 2 is pressed against the bottom Ab of the water tank A. At the same time, only the injection ports 27, 27 disposed at one peripheral side of the equipment main body 2 are opened, and the equipment main body 2 is moved laterally in an arbitrary direction while pressing against the bottom Ab of the water tank A, and the dirt depositing on the bottom Ab is cleaned and removed by the rotary brush 7.

Moreover, as shown in FIG. 2, sediments B such as sand and pebbles spread in the bottom Ab of the water tank A are sucked, and the dirt depositing on the sediments B is cleaned and removed by the rotary brush 7, and only the storage water W is sucked in through pores 6b . . . of the shield plate 6 to prevent passing of sediments B such as sand and pebbles larger than the size of the pores 6b . . . , and the sediments B accumulated in the peripheral edge of the shield plate 6 are dropped by gravity or wiped off by the removal brush 12.

Figure 8:
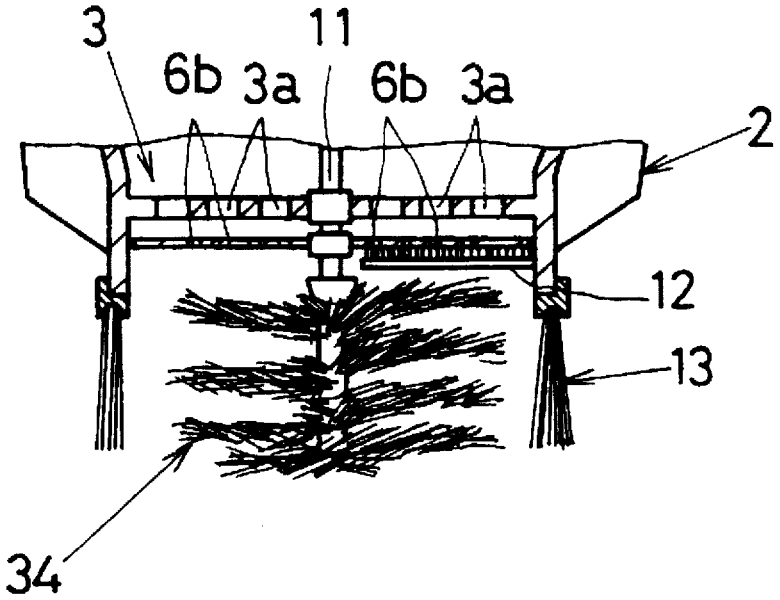
FIG. 8 is a longitudinal sectional side view showing cleaning operation of water tank bottom by a spiral brush.

In other method, as shown in FIG. 8, after pulling out the rotary brush 7 from the projection side end portion of the rotary shaft 11 projecting to the suction side of the equipment main body 2, the center of rotation of spiral brush 34 is inserted and fixed in the projection side end portion of the rotary shaft 11, and the sediments B such as sand and pebbles spread in the bottom Ab of the water tank A are sucked up by force by the suction force by rotation of the suction impeller 8 and the lifting force by rotation of the spiral brush 34, and the dirt depositing on the sediments b such as sand and pebbles can be cleaned and removed efficiently.

When taking out the water tank cleaning machine 1 out of the tank, only the injection ports 29, 29 disposed at both sides ahead of the equipment main body 2 are opened, and the equipment main body 2 is changed in direction to upward position by the discharge force of the storage water W discharged from the injection ports 29, 29. At the same time, sucking in storage water W from the suction ports 3a . . . of the first suction chamber 3, the storage water W is discharged from the second discharge port 23 of the equipment main body 2, and the equipment main body 2 is lifted to the water surface, and taken out of the tank. Alternatively, by stopping all functions of the equipment main body 2, the equipment main body 2 floats on the water surface only by the buoyancy of the float member 22. Or, the equipment main body 2 may be towed and taken out of the tank by towing means such as wire and chain.

In this way, the torque of the motor 9 is amplified by the torque converter 10, and transmitted to the rotary brush 7, and a larger torque is obtained as compared with the mechanism of rotation by directly coupling the motor 9 and rotary brush 7, and the power transmission efficiency is also high because the impellers 14, 15 in front and rear parts are disposed closely. If the hand of the worker or object such as creature touches the rotary brush 7, only the rotary brush 7 is stopped by the rotation resistance caused at the time of contact, thereby preventing the object from being injured, so that it is easy to handle and safe.

Furthermore, since the storage water W contained in the water tank A is filtered by the filter 21 in the cleaning process, contamination of storage water W during cleaning is prevented, and water quality and environments suited for rearing aquatic creature such as fishes and mammals may be maintained. Still more, by cleaning while keeping the storage water W in the water tank A, time and labor for discharging or replacing storage water W in prior art can be omitted, and dirt depositing on the wall Aa and bottom Ab of the water tank A, and dirt depositing on the sediments B such as sand and pebbles can be cleaned and removed easily, so that the working efficiency and cleaning efficiency may be enhanced.

When the water quality of the storage water W is lowered below a specific level, the changeover valve 25 provided in the second discharge port 23 of the equipment main body 2 is closed, and the changeover valve 19 provided in the first discharge port 20 is changed over to directly couple the discharge port 4b of the second suction chamber 4 and the first discharge port 20 of the equipment main body 2, and by connecting a discharge rubber hose (not shown) to the first discharge port 20, the storage water W in the water tank A is plumped up by the rotary action of the suction impeller 8 pivoted on the second suction chamber 4, so that it may be applied in pumping operation for discharging the storage water W.

Figure 9:
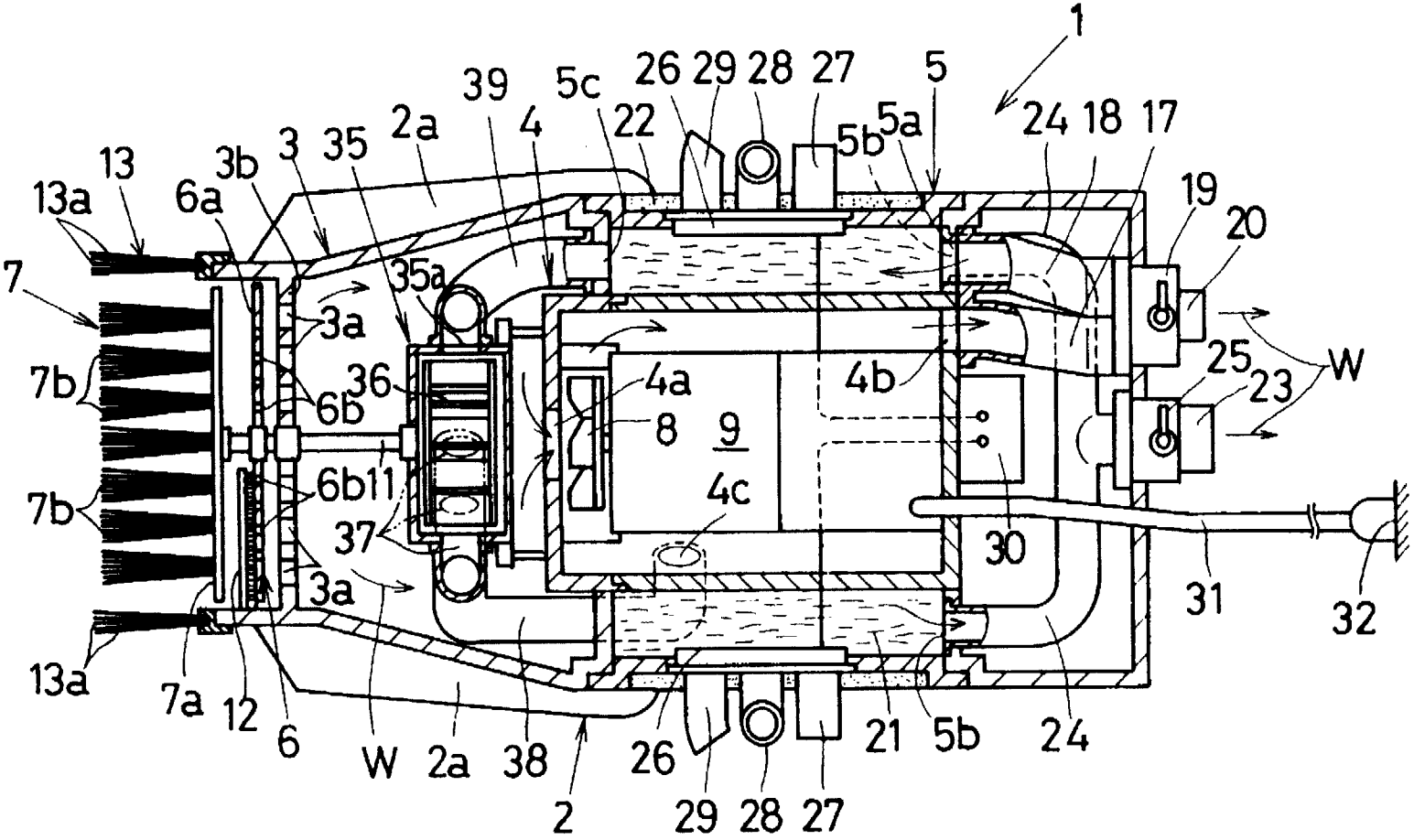
FIG. 9 is a lateral sectional plan view showing other embodiment of a water tank cleaning machine of the invention.

FIG. 9 shows a water tank cleaning machine 1 in a second embodiment for rotating the rotary brush 7 by the storage water W discharged from the second suction chamber 4, in which a front impeller 36 of water wheel type is pivoted in an impeller compartment 35 25 fixed in the front wall of a second suction chamber 4, a rotary shaft 11 of a rotary brush 7 is directly coupled in the center of rotation of the front impeller 36, three discharge nozzles 37 . . . connected to the lower periphery of the impeller compartment 35 and a discharge port 4c formed in the side wall of the second suction chamber 4 are connected through a return passage 38, a discharge port 35a formed in the upper periphery of the impeller compartment 35 and a suction port 5a,5b formed in the front wall of a filter chamber 5 are connected through a discharge passage 39, and the discharge direction of discharge nozzles 37 . . . is specified in direction so that torque may be applied in one direction to the front impeller 36.

That is, by rotating a suction impeller 8 by driving force of a motor 9, and sucking storage water W in the water tank A through suction ports 3a, 4a formed in suction chambers 3, 4, the storage water W is supplied from the discharge port 4c formed in the second suction chamber 4 into the discharge nozzles 37 . . . connected to the impeller compartment 35 25 through the return passage 38. The storage water W injected from the discharge nozzles 37 . . . is blown to the front impeller 36 to offer torque, and the rotary brush 7 directly coupled with the front impeller 36 is rotated, and therefore, same as in the first embodiment, without having to discharge or replace the storage water W stored in the water tank A, the dirt depositing on the wall Aa and bottom Ab of the water tank A, and sediments B such as sand and pebbles can be cleaned easily. If the hand of the worker or object such as creature touches the rotary brush 7, only the rotary brush 7 is stopped by the resistance caused at the time of contact, thereby preventing the object from being injured, so that it is easy to handle and safe.

Figure 10:
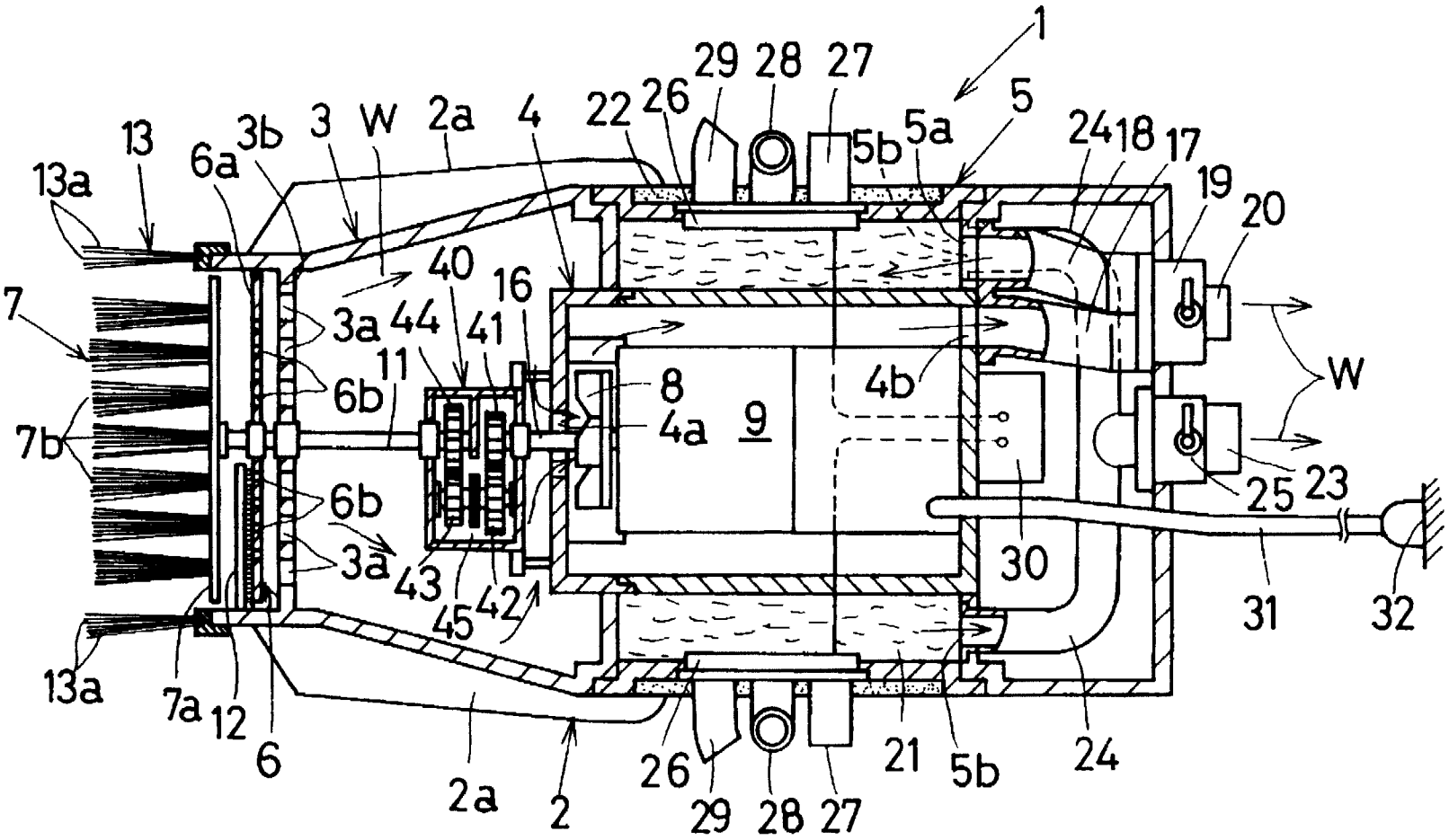
FIG. 10 is a lateral sectional plan view showing a different embodiment of a water tank cleaning machine of the invention.

FIG. 10 shows a water tank cleaning machine 1 in a third embodiment for rotating a rotary brush 7 by slowing down the torque of a motor 9 by a reduction gear 40 disposed in a first suction chamber 3, in which a rotary shaft 16 of a motor 9 is directly coupled to the input side of the reduction gear 40 fixed to the front wall of a second suction chamber 4, a rotary shaft 11 of the rotary brush 7 is directly coupled to the output side of the reduction gear 40, and the torque of the motor 9 is reduced by large and small gears 41, 42, 43, 44 and a clutch 45 pivoted in the reduction gear 40. That is, by rotating the suction impeller 8 by the driving force of the motor 9, storage water W in the water tank A is sucked in through suction ports 3a, 4a formed in the suction chambers 3, 4, and the rotary brush 7 is rotated by reducing the torque of the motor 9 by the gears 41, 42, 43, 44 and clutch 45 pivoted in the reduction gear 40, and therefore, same as in the first embodiment, without having to discharge or replace the storage water W stored in the water tank A, the dirt depositing on the wall Aa and bottom Ab of the water tank A, and sediments B such as sand and pebbles can be cleaned easily. If the hand of the worker or object such as creature touches the rotary brush 7, only the rotary brush 7 is stopped as the clutch 45 idles by the rotation resistance caused at the time of contact, thereby preventing the object from being injured, so that it is easy to handle and safe.

Figure 11:
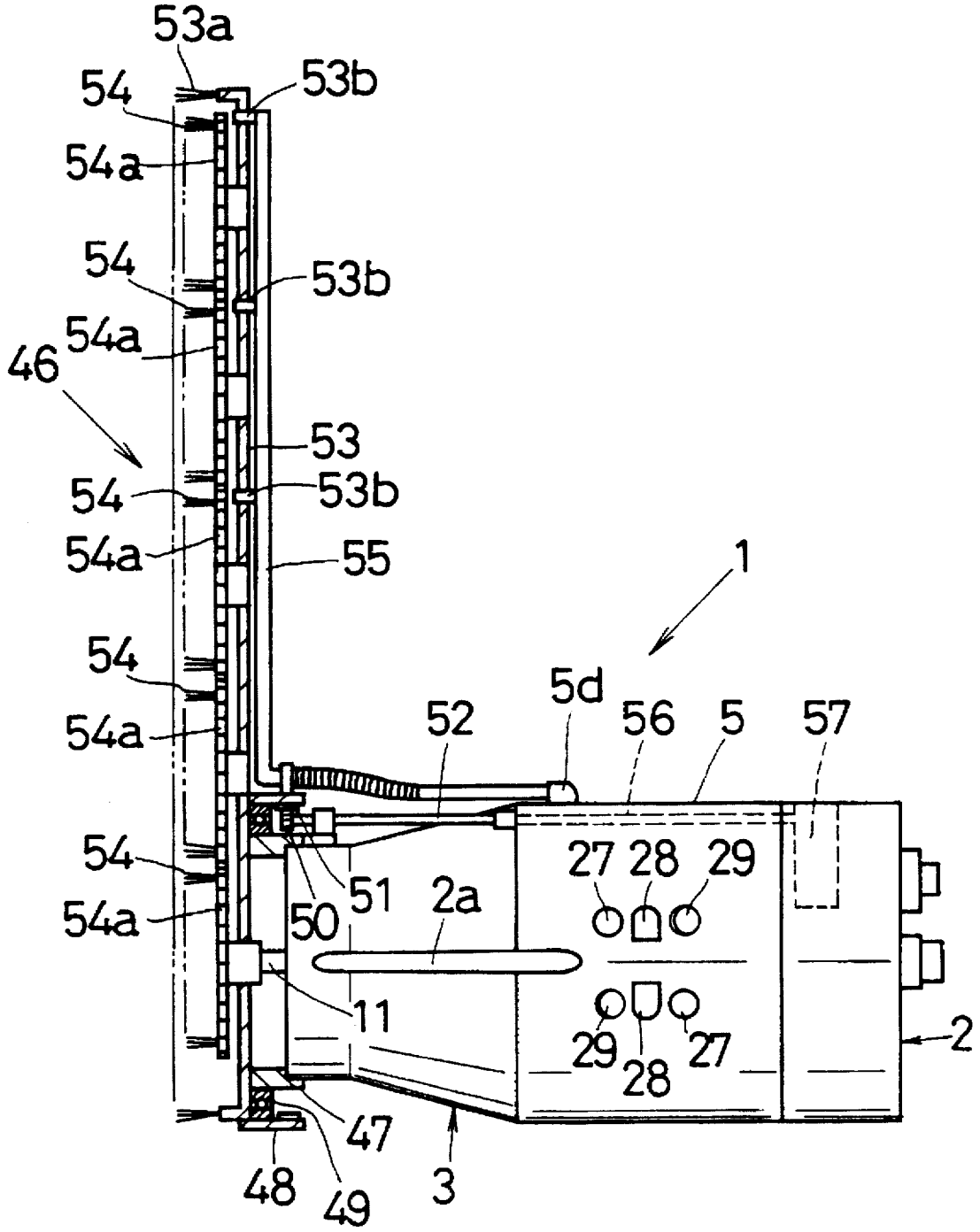
FIG. 11 is a side view showing a further different embodiment of a water tank cleaning machine of the invention.

FIG. 11 shows a water tank cleaning machine 1 in a fourth embodiment for cleaning the inner wall of a water tank A by an interlocked brush 46, in which a fixed ring 47 and a rotary ring 48 for composing the interlocked brush 46 are rotatably fitted through a bearing 49, a gear 50 supported on one side periphery of the fixed ring 47 and a rack 51 formed in the inner circumference of the rotary ring 48 are engaged with each other, and a rotary shaft 52 pivoted on one peripheral side of the fixed ring 47 and gear 50 are coupled directly with each other. Moreover, a plurality of rotary brushes 54 . . . are pivoted on the central surface of the longitudinal side of the support arm 53 fixed on the rotary ring 48, gears 54a . . . formed on the outer peripheral edge of the rotary brushes 54 . . . are engaged with each other, a multiplicity of bristles 53a . . . are planted on the front side peripheral edge of the support arm 53, and nozzles 53b . . . projected to the front side of the support art 53 and discharge hose 55 piped to the rear side are connected with each other.

That is, when cleaning the inner wall of the water tank A, after removing the rotary brush 7 and brush cover 13 in FIG. 1, the fix ring 47 is fitted and fixed in the front peripheral edge of the equipment main body 2, and the rotary shaft 11 is inserted and fixed in the center of rotation of the rotary brush 54 pivoted on the lower end of the support arm 53. The rotary shaft 52 pivoted on the fixed ring 47 and the rotary shaft 56 pivoted on the equipment main body 2 are mutually inserted and coupled, and the discharge hose 55 piped to the support arm 53 and the discharge port 5d formed in the front wall of the filter chamber 5 are connected with each other. In ordinary cleaning operation, the discharge port 5d is closed.

Next, by rotating the rotary shaft 11 by driving force of the motor 9 incorporated in the equipment main body 2, the rotary brushes 54 . . . pivoted on the support arm 53 are interlocked and rotated in confronting directions to keep the lateral balance of the equipment main body 2. For example, the rotary brushes 54 . . . pivoted on the upper end of the support arm 53 are pressed against the wall Aa projecting upward of the storage water W in the water tank A, and the storage water W discharged from the nozzles 53b . . . is brown to the wall Aa and rotary brushes 54 . . . to clean. By the driving force of a driving motor 57 incorporated at the rear side of the equipment main body 2, the support arm 53 can be rotated to a desired angle through the gear 50 and rack 51, or the equipment main body 2 is rotated to change the direction of the support arm 53, and therefore the wall Aa and bottom Ab of the water tank A are cleaned by the rotary brushes 54 . . . pivoted on the support arm 53, and the sediments B such as sand and pebbles spread in the water tank bottom Ab can be cleaned. If the hand of the worker or object such as creature touches the rotary brush 54, only the rotation of all rotary brushes 54 . . . is stopped by the rotation resistance caused at the time of contact, thereby preventing the object from being injured, so that it is easy to handle and safe.

Figure 12:
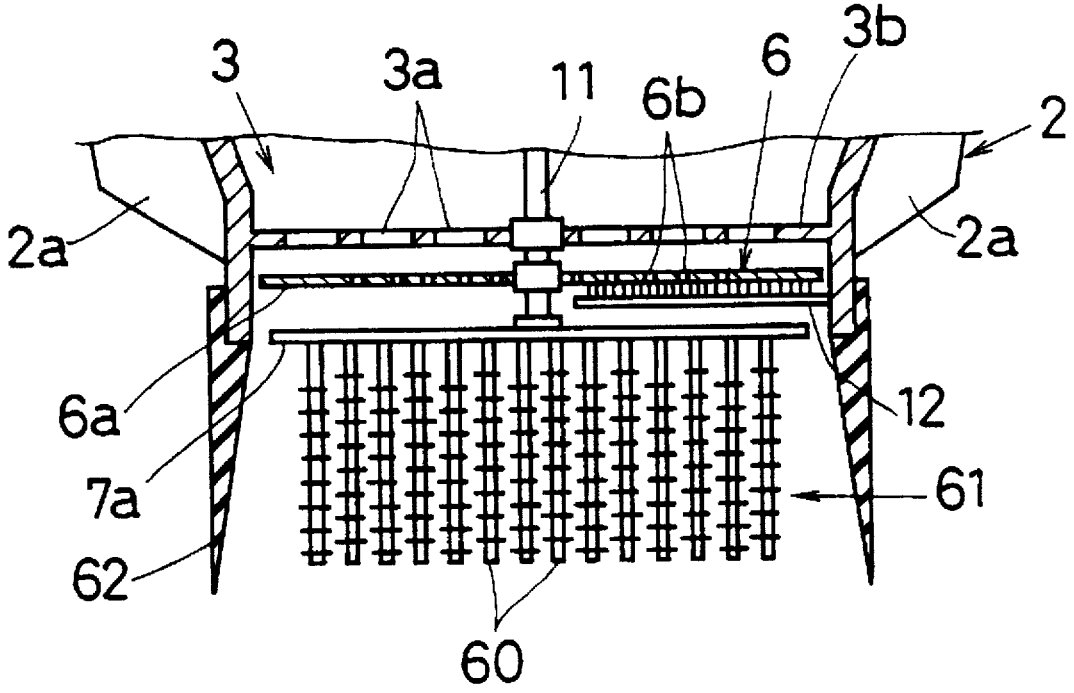
FIG. 12 is an explanatory diagram showing a different embodiment of wiping means.

FIG. 12 shows other embodiment of wiping means, in which a rotary brush 61 is formed by planting a multiplicity of brushes 60 flexibly composed of elastic material such as synthetic rubber and synthetic resin at specific intervals at the front side of a rotary plate 7a, and a brush cover 62 of synthetic rubber or synthetic resin for entirely surrounding the rotary brush across a spacing is disposed at the front peripheral edge of the first suction chamber 3, and thereby the suction direction of the storage water W is defined.

Such constitution provides the same action and effect as in the foregoing embodiments, and in FIG. 12, therefore, same reference numerals are attached to corresponding parts in the preceding drawings, and detailed descriptions are omitted.

In correspondence between the constitution of the invention and the foregoing embodiments, The rotary means of this invention corresponds to the motor 9 in the embodiments, and similarly The wiping means corresponds to the rotary brush 7, spiral brushes 34, interlocked brush, and rotary brush 61, and the power transmission means corresponds to the torque converter 10, front impeller 36 of water wheel type and related constitution, and reduction gear 40.

The invention is not limited to the illustrated embodiments alone.

In the embodiments, the motor 9 and electromagnetic changeover valves 26, 26 are driven and controlled by the wireless controller 33, but, for example, they may be also driven and trolled by a control circuit (not shown) incorporated in the equipment main body 2 or a wired controller (not shown), and the motor 9 may be also driven by a battery (not shown) incorporated in the equipment main body 2. As rotating means, meanwhile, the motor 9 may be also replaced by a rotary actuator.

I claim:

1. A water tank cleaning machine for cleaning a submerged surface of the tank, said machine comprising:

(a) a main body with an internal space having a hollow shape which is divided into a first suction chamber and a second suction chamber, said main body having a suction port formed in both the first and second suction chambers at a front side thereof and a discharge port formed in the second suction chamber at a rear side thereof, said main body further having a cleaning filter chamber formed therein;

(b) a suction impeller located at a rear position of the suction port formed in the second suction chamber, said suction impeller being coupled with a rotating means which is incorporated in the main body;

(c) a wiping means located at a front side of the main body and at a front position side of the suction port formed in the first suction chamber;

(d) power transmission means located within the main body for transmitting the torque of the rotating means to the wiping means; and (e) whereby rotation of the suction impeller by the rotating means sucks in storage water in the tank through the suction ports and into said cleaning filter chamber, after which the filtered storage water is directed to said discharge port and back into the tank, the rotating means also rotating said wiping means through said power transmission means to clean internal surfaces of the tank.

2. The machine of claim 1, wherein the power transmission means pivots a pair of impellers closely in an axial direction of a shaft of the rotating means, in an impeller compartment formed in the first suction chamber; and wherein said pair of impellers comprising a front impeller pivoted at an output side of the impeller compartment and the wiping means being coupled with said front impeller and a rear impeller pivoted at an input side of the impeller compartment and the suction impeller being coupled with said rear impeller.

3. The machine of claim 1, wherein the power transmission means is comprised of an impeller in an impeller compartment formed in the first suction chamber, the impeller pivoted in the impeller compartment and wiping means are coupled with each other, and a discharge port is provided in a torque applying direction relative to the impeller, at one side of the impeller compartment; wherein said discharge port and a discharge port formed in the second suction chamber are connected through a return passage; and wherein a discharge port formed on another side of the impeller compartment and a suction port formed in the cleaning filter chamber are connected through a discharge passage.

* * * * *